US005421558A

United States Patent [19]

Vesper

[11] Patent Number: 5,421,558

[45] **Date of Patent: * Jun. 6, 1995**

[54] BUILDING WALL CONSTRUCTION

[76] Inventor: Dale E. Vesper, 4937 Pompano Dr., New Port Richey, Fla. 34652

[ * ] Notice: The portion of the term of this patent subsequent to Feb. 9, 2010 has been disclaimed.

[21] Appl. No.: 14,640

[22] Filed: Feb. 8, 1993

Related U.S. Application Data

[63] Continuation-in-part of Ser. No. 178,261, Apr. 6, 1988, Pat. No. 5,184,808, and a continuation-in-part of Ser. No. 835,241, Feb. 12, 1992, and a continuation-in-part of Ser. No. 912,895, Jul. 13, 1992.

[51] Int. Cl.[6] ..... E04H 17/16

[52] U.S. Cl. ..... 256/31; 256/24; 256/73; 52/793; 52/309.7

[58] Field of Search ..... 256/31, 24, 19, 73, 256/DIG. 5, 25-28; 52/793, 781, 779, 809, 309.7, 309.17, 601, 780, 387, 386, 384, 314, 586, 241, 239, 656, 582, 745.2, 281, 309.9, 309.11, 821, 295, 293.1; 405/285, 282

[56] References Cited

U.S. PATENT DOCUMENTS

| | | | |
|---|---|---|---|
| 701,588 | 6/1902 | Liebau | 256/19 |
| 1,933,483 | 10/1933 | Pennoyer | 405/285 |
| 1,983,020 | 12/1934 | De Vol | 52/281 X |
| 2,039,601 | 5/1936 | London | 52/779 X |
| 2,302,047 | 11/1942 | Olsen | 52/781 X |
| 3,131,514 | 5/1964 | Siek | 32/384 X |
| 3,600,864 | 8/1971 | Godley et al. | 52/314 X |
| 3,646,715 | 3/1972 | Pope | 52/309.9 |
| 4,154,030 | 5/1979 | Huguet | 52/300 X |
| 4,408,434 | 10/1983 | Collins | 52/745.2 |
| 4,712,352 | 12/1987 | Low | 52/809 |
| 4,838,524 | 6/1989 | McKeown et al. | 256/24 |

*Primary Examiner*—Randolph A. Reese
*Assistant Examiner*—Harry C. Kim
*Attorney, Agent, or Firm*—Charles A. McClure

[57] ABSTRACT

Building walls comprising flanged supporting posts spaced on centers and uniform lightweight panels doubly slotted at their ends fitting between adjacent posts and engaging such flanges. The engaged post flanges are substantially concealed from view.

19 Claims, 2 Drawing Sheets

BUILDING WALL CONSTRUCTION

This is a continuation-in-part of my applications: Ser. No. 178,261 filed 6 Apr. 1988, now U.S. Pat. No. 5,184,808; Ser. No. 835,241 filed 12 Feb. 1992; and Ser. No. 912,895 filed 13 Jul. 1992; those applications are incorporated by this reference.

FIELD OF THE INVENTION

This invention relates to construction of exterior building or other preferably load-bearing walls, concerning especially increased durability, economy, and structural simplicity of such walls.

BACKGROUND OF THE INVENTION

Most walls with ground support, including fence walls, look fine when just installed. However, many tilt, sag, and crack as time passes and the underlying support shifts slightly under the weight of the materials used. There is a need for a more durable structure, and some innovators have made related contributions. Russo in U.S. Pat. No. 3,869,109 discloses I-beam posts with hardware to retain his frame members. Totten in U.S. Pat. No. 4,007,919 teaches hollow I-beam posts with interlocking hollow rails filled with plastic. Kavanaugh in U.S. Pat. No. 4,288,962 discloses a wall made by affixing plasterboard to the exterior of aligned flanges (perforated) of metal I-beams, and spraying plastic foam to coat the flange-adjacent surface of such board and to fill in until flush, and finally coats the exterior with adhesive and then with stucco. Those approaches fail to provide the combination of features that my invention offers.

The present inventor's foregoing patent applications disclose fence walls comprising upright metal posts and intervening panels of lightweight foamed plastic, preferably reinforced with component horizontal channel-shaped members and coated with protective compositions, and optionally faced with brick or other decorative materials. Such walls have proved their durability in actual use notwithstanding their exposure to weather. The present invention extends similar post-and-panel construction to building walls, especially—but not necessarily only—to exterior or other usually load-bearing walls.

SUMMARY OF THE INVENTION

A primary object of the present invention is to adapt proven post-and-panel fence wall technology to building walls.

Another object of this invention is to provide new lightweight wall panel structures suitable for use in load-bearing walls.

A further object of the invention is to provide reinforced insulating panels suitable for use in or as exterior building walls.

Yet another object of this invention is to provide exterior building wall structures with decorative facing brick or the like on a panel having the foregoing characteristics.

A still further object of the invention is to accomplish the foregoing objects more economically and simply than lesser results are attained nowadays.

In general, the objects of the present invention are attained by placing flanged posts upright on centers at spaced intervals, providing wall panels of such interval length with flange-receiving slots along their vertical edges, and inserting such panels between adjacent posts with their flanges received within such slots.

More particularly, such panels are reinforced internally with horizontally extending members adapted to be secured to the posts, and their faces are covered, as with cementitious coating material, sometimes over added screening, or with facing brick or the like.

Other objects of this invention, together with means and methods for attaining the various objects, will be apparent from the following description and the accompanying diagrams of preferred embodiments presented by way of example rather than limitation.

DETAILED DESCRIPTION

Figure 1:
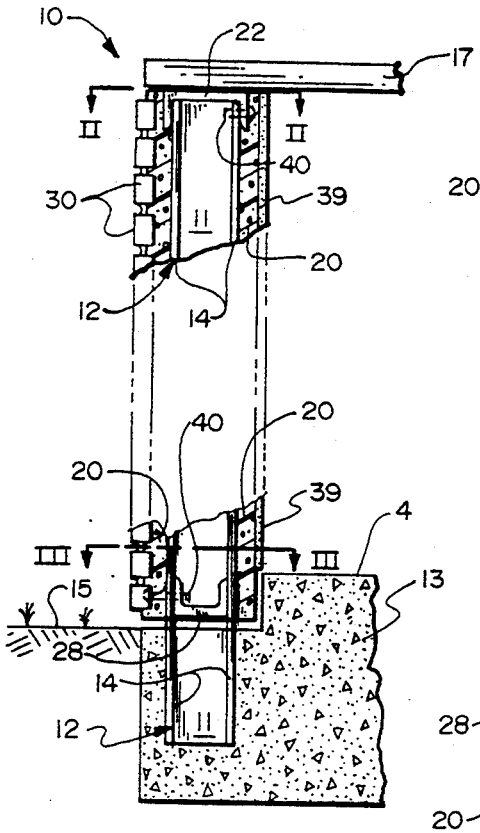
FIG. 1 is a fragmentary sectional elevation through a building wall of the present invention—and associated structure.

FIG. 1 shows, in fragmentary sectional elevation, building wall 10 of this invention, at the location of one of a succession of supporting posts 12, with the exterior at the left and the interior at the right of the view. Concrete footing 13 extends from underground upward to the exterior ground (or grade) level 15, and continues at that level underneath the wall to the interior, where it steps up to slab or floor level 4. Embedded in the footing is the base of upright post 12, which (as shown in subsequent views) is H-shaped in plan, such as is often called an I-beam (or H-beam). In this view the central stem or web 11 of the post is readily visible parallel to the drawing sheet and perpendicular to pair of mutually parallel flanges 14 (edge-on here), which run the entire length of the post.

Figure 5:
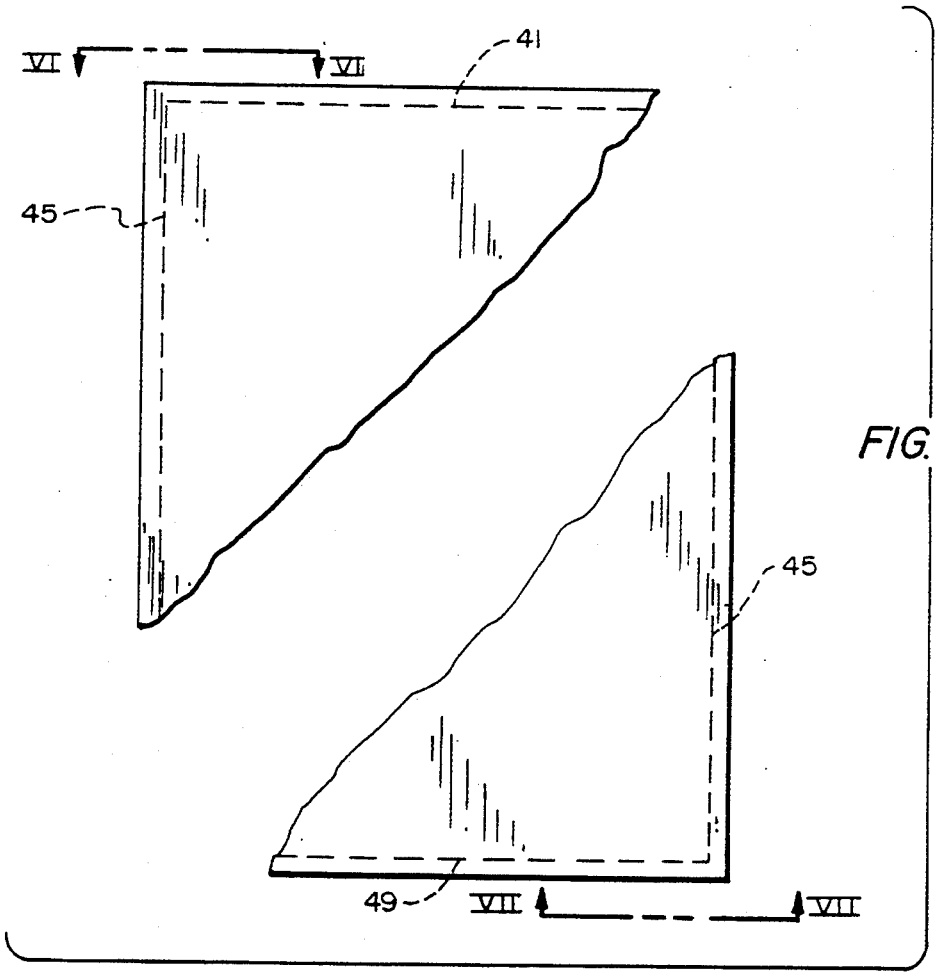
FIG. 5 is a fragmentary view of a wall panel of this invention, broken away along a diagonal from the lower left to the upper right.
Figure 6:
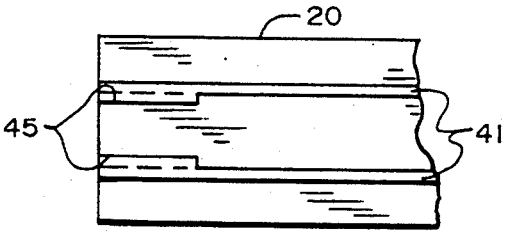
FIG. 6 is a fragmentary plan of a top corner of the panel, at VI—VI in FIG. 5.
Figure 7:
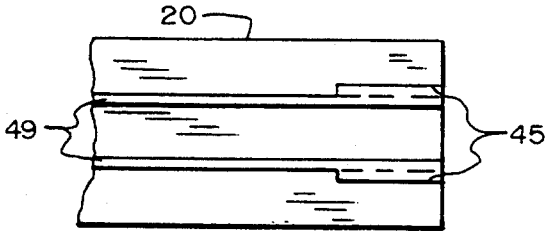
FIG. 7 is a fragmentary plan of a diagonally opposite bottom corner of the panel, at VII—VII in FIG. 5.

Panel 20 extends from its bottom edge at the grade level upward to the top end of the post. The left or exterior face of the panel has horizontal grooves therein filled with courses of brick 30, with mortar-like beading 31 of silicone or similar material intervening. The right or interior face of the panel is covered with coating 39. Channel-shaped bottom reinforcing member 28 fits with its sidewalls upright in slots (49, v. FIGS. 5, 7) in the bottom edge of the panel between overlapping post flanges 14 fitting in slots (45, v. FIGS. 5–7) in the panel vertical edge(s). Channel-shaped top reinforcing member 22 fits with its sidewalls inverted in slots (41, v. FIGS. 5, 6) in the top edge of the panel and just outside and overlapping post flanges 14 fitting in the panel vertical slots as noted. Overhead member 17 rests on the top of the post and may connect to or carry a floor or roof truss or similar structure (not shown).

Figure 2:
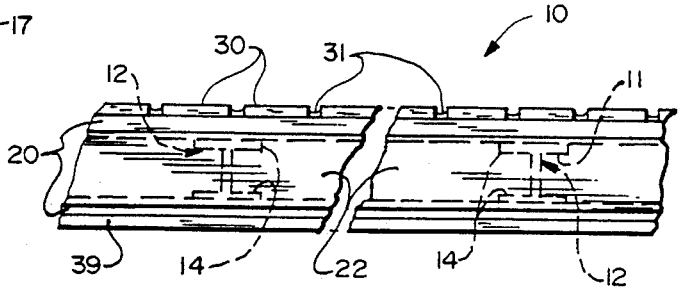
FIG. 2 is a fragmentary plan view of the top of the wall, taken at II—II in FIG. 1.

FIG. 2 shows, in plan just under overlying member 17, building wall 10 of the preceding view, here oriented with its brick-covered exterior face upward and its smooth-coated interior face downward. Adjacent pair of posts 12 (shown in broken lines because underneath reinforcing member 22) are oriented with pairs of spaced flanges aligned parallel to both of the wall faces, and with panel 20 intervening (partly broken away to conserve space). Portions of similar panels extend leftward and rightward from the respective posts, with the flanges of the posts received in vertical edge slots of the panels. Only a small slit 25 intervenes between adjacent ends of the panels flanking a single post—which therefore is substantially concealed from view even before addition of brick 30 and intervening beading 31 to the exterior face, and addition of coating 39 to the interior face, of either panel. The sidewalls and intervening bed portion of inverted channel-shaped upper reinforcing member 22 overlap the top ends of the post flanges and fit downward into slots in the panel top edge.

Figure 3:
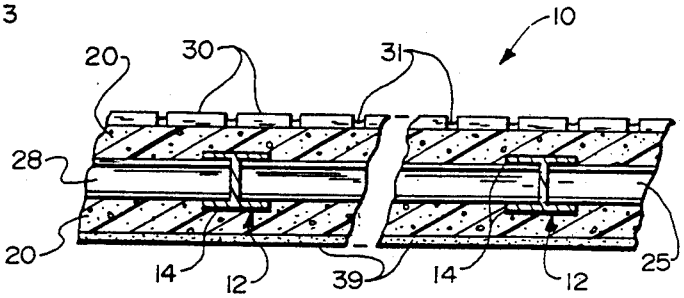
FIG. 3 is a fragmentary transverse sectional plan, taken near the bottom of the wall, at III—III in FIG. 1.

FIG. 3 shows building wall 10, in sectional plan just above the level of floor 4. This view differs from FIG. 3 by showing panel 20 in section (shaded for foamed plastic) and showing posts 12 in solid because lower reinforcing member 28 is oriented with its sidewalls upright between and contiguous with overlapping post flanges 14.

Figure 4:
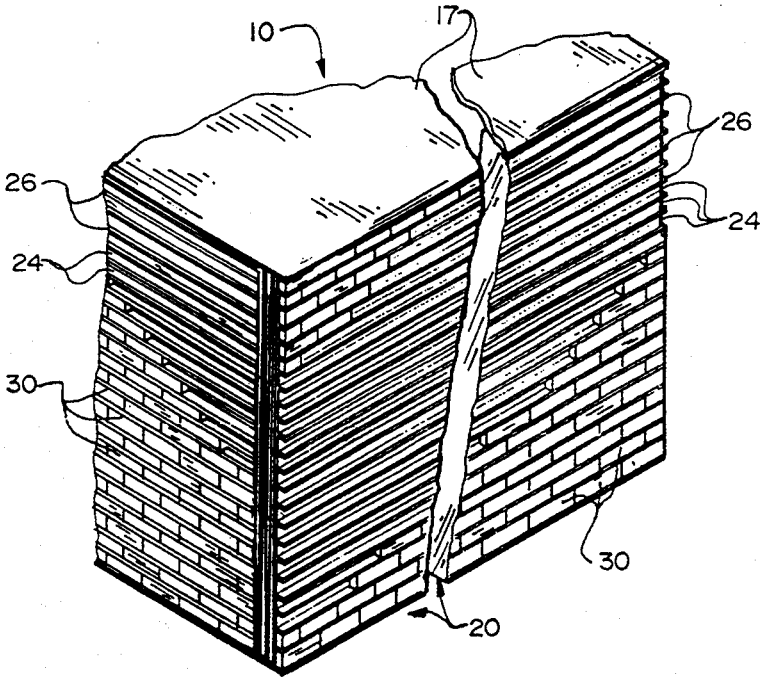
FIG. 4 is a fragmentary perspective view of an exterior corner of the same building wall with brick facing partly completed.

FIG. 4 shows, in perspective from above and at the left, the exterior face of the building wall 10 of this invention, revealing spaced rows of horizontal grooves 24, partly filled with brick 30, and intervening ridges 26 partly filled with beading 31. Overhead member 17 is the only other associated building member in this view. Also visible are flange-receiving slots 45 spaced apart from each other and from the faces in the vertical side edges of the panel.

FIG. 5 shows panel 20 face-on, in fragmentary elevation, including especially the upper left corner and the lower right corner. In addition to its solid rectangular outline this view shows (in dashed lines) slot(s) into and along its edges, as follows: 41 at a given depth into the horizontal top edge, and 49 at a given depth into the horizontal bottom edge, and 45 at another given depth into the vertical edges of the panel, at both the left and the right sides.

FIG. 6 shows, in top plan, the upper left corner of the panel of FIG. 5, including pair of slots 41 flanking the center line (not indicated) of the panel top edge and spaced remotely from the faces. These slots accommodate the downturned sidewalls of the upper inverted channel-like reinforcing member (22, not shown here). Just within the left edge of the panel the slotting widens evenly inward (narrowing the central part or tenon of the panel) at the junction with vertical side edge slots 45 to accommodate spaced flanges (14) of the supporting posts, which the bed of the channel overlaps as shown in FIGS. 1 and 2.

FIG. 7 shows, in bottom plan, the lower right corner of that panel, including pair of slots 49 flanking the omitted center line of the panel bottom edge and spaced remotely from the faces. Just within the right edge, the slotting widens evenly outward, at the junction with vertical side edge slots 45 to accommodate the spaced flanges (14) of the supporting posts, which lap laterally about the upturned sidewalls of the upright channel-like reinforcing member (28, not shown here) as shown in FIGS. 1 and 3.

Figure 8:
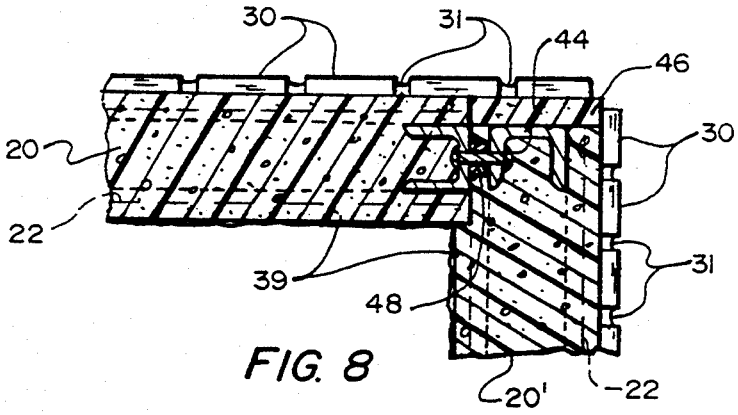
FIG. 8 is a fragmentary sectional plan of a corner of a building wall of this invention, taken at an intermediate level.

FIG. 8 is a sectional plan of a building wall of this invention at a corner, viewed at an intermediate level (between the upper and lower reinforcing members of intersecting panels 20 at the left and 20' at the right. Two C-shaped (in plan) uprights standing end-on replace the previously shown I-beam (or H-beam)—which itself may be viewed as (or actually comprise) two such C-shaped members joined back-to back. However, here the bed of the left C-shaped upright is juxtaposed to a sidewall of the like right upright, spaced apart by the thickness of interposed spacer 48 and retained so juxtaposed by rivet 44 through them and the spacer. The spacer thickness equals the thickness of a down-turned sidewall of channel-shaped upper reinforcing member, to allow the bed of the channel to overlap the top of the right C-shaped upright—next to the end of the left C-shaped upright. For the sake of clarity the respective downturned sidewalls of the respective upper reinforcing members (22) are superimposed in broken lines onto this view.

Also in FIG. 8 (as in FIG. 4), the walls forming the outside of the corner are grooved and faced with brick 30, whereas the inside of the corner is covered with coating 39, as in FIGS. 1 to 3. For the correct spacing, the inside wall of right panel 20' is relieved to accommodate the inside wall of the right panel. Also, as the corner perimeter exceeds the corresponding inside dimension, the panel at the left does not extend far enough to the right to cover the end of the panel at the right, piece of panel material 46 is added at the right panel, flush with the outside wall of the left panel.

The materials used in constructing the building walls of this invention are conventional and readily available in the marketplace. Thus, the posts are conveniently metallic, usually galvanized steel. Such posts are suitable in 18 gauge up to about 6 feet in height and 10 feet in post length (including base portion), and in suitably heavier gauges (such as 8 to 16) to as much as 10 feet of exposed height and 16 feet in length. At the ground floor the base of each post is embedded in a concrete footing whose depth depends upon such factors as weight to be supported, wind load, and freezing depth. The horizontal reinforcing members are similarly usually metallic and of comparable gauge for their lengths. They can—but often need not—be secured to the panels by adhesive, by dielectric heating, or other suitable method.

The panels are made of suitable foamed polymeric composition, such as expanded polystyrene or polyurethane (more expensive). In the absence of brick or other ceramic or equivalent facing material, the exterior panel surface is preferably coated with a protective material, usually mainly a cementitious grout, with a low-alkali portland cement base, plus admixture of a substantial part of elastomeric polymer, such as a vinyl-acrylic or an epoxy resin. Coatings are preferably reinforced by fibrous material mixed thereinto, such as glass or polyalkylene fibers, plus an expansible siliceous or other mineral aggregate capable of reducing the overall density. A coating-reinforcing fabric may be added, made of glass, metallic wire, or polymeric composition, preferably in open-mesh form.

In overall appearance, the building walls of this invention are as attractive as those made in any other way. They require less maintenance because they do not crack in the manner of concrete block walls (when the ground supporting them shifts underneath). The weight of the walls of this invention is carried by the posts, which are in footings massive and extensive enough not to shift.

In performance, the building walls of this invention meet and usually exceed the customary requirements for impact strength, wind resistance, and other physical characteristics. Insulation requirements are readily met as the R-factor per inch of thickness is about 2.6, so that a 4-inch thickness is at least an R10, a 6-inch thickness an R15, and an 8-inch thickness at least an R20.

Other advantages of these building walls will become apparent and will accrue to the benefit of persons who build, occupy, and maintain them. They can be installed in much less time than a more conventional cinder or concrete block wall can be laid, and in much less time than a frame wall can be constructed and sheathed. Even if the material costs were the same—instead of less as they should be—the saving in labor cost is so great that this new building wall is much more economical.

Although exterior walls have been emphasized in the foregoing description, this invention is applicable to interior walls as well. Similarly, though only a single storey is described and illustrated, the invention is adapted also to multi-storey buildings. Posts can be secured to a plate at floor or subfloor level for either ground floor or higher floors, although for ground floors at least some of the posts for exterior walls are preferably set in concrete footings as described and illustrated.

Variants on the basic building wall structure of this invention have been suggested. Other modifications made be made, as by adding, combining, or subdividing parts or steps while retaining some of the advantages and benefits of the invention, which itself is defined in the following claims.

The claimed invention:

1. A building wall having opposite vertical faces, comprising a plurality of flanked posts H-shaped in plan, upstanding from underground footings on spaced centers, oriented with their pairs of H-flanges in mutual alignment, and with the post flanges in each side-by-side flange pair spaced apart by a given flange separation;

and preformed two-faced polymeric foam panels thicker than the post flange separation and extending substantially the entire center-to-center distance between adjacent posts, having substantially horizontal top and bottom edges, and also having vertical side edges slotted parallel to but apart from the panel faces and adapted to receive adjacent side-by-side post flanges substantially entirely therewithin.

2. Wall according to claim 1, wherein the panel is supported by and between the posts with its top horizontal edge doubly slotted and accommodating therein spaced downturned sidewalls of an inverted channel-shaped reinforcing member having an intervening bed portion interconnecting the spaced sidewalls and extending along the top edge of the panel.

3. Wall according to claim 2, wherein the spacing of sidewall is enough greater than the post flange separation that the reinforcing member fits over and rests on top of the post flanges with the sidewalls contiguously flanking the post flanges.

4. Wall according to claim 3, including fastener means, at each end of the reinforcing member, interconnecting at least one of the sidewalls to a post flange at each end thereof.

5. Wall according to claim 1, wherein the panel has its bottom horizontal edge doubly slotted and accommodating therein upturned sidewalls of a horizontal channel-shaped reinforcing member extending along the panel substantially the center-to-center distance, and the panel is supported by and between the posts.

6. Wall according to claim 2, wherein the spacing of sidewalls is enough less than the post flange separation that the reinforcing member bits with sidewalls between the post flanges and contiguous therewith.

7. Wall according to claim 6, including fastener means, at each end of the reinforcing member, interconnecting at least one of the sidewalls of the channel to a contiguous post flange.

8. An improved lightweight substantially rectangular polymeric foam building wall panel having two mutually parallel outer vertical faces and bounded along its perimeter by horizontal top and bottom edges and a pair of vertical side edges joining the top and bottom edges;

each vertical side edge having spaced apart therein a pair of parallel slots to a first given depth, each of the respective pairs of vertical side edge slots being adapted to receive therein and to substantially conceal from the exterior a pair of similarly spaced flanges of adjacent upright posts adapted to support the panel; and the horizontal top edge having spaced apart therein a pair of parallel slots to a second given depth adapted to receive therein similarly spaced sidewalls of an inverted channel-shaped reinforcing member extending from one vertical side edge to the other vertical side edge of the panel and to overlap and be secured to the spaced flanges.

9. An improved building wall panel according to claim 8, wherein the horizontal top edge has spaced apart therein a pair of parallel slots adapted to receive therein the sidewalls of an upright channel-shaped reinforcing member extending from one vertical side edge to the other vertical side edge of the panel and adapted to lap and be secured to the spaced flanges.

10. An improved building wall panel according to claim 8, in combination with and installed between a pair of upright posts based in underground footings, each post having a pair of parallel flanges extending toward those of the other post in mutual alignment, the flanges of the respective posts fitting in the slots of the respective vertical edges of the panel, each such flange extending substantially entirely therewithin from the top to the bottom side edges of the panel, including fastener means securing reinforcing member sidewalls to the lapped flanges.

11. An improved building wall panel installed between a pair of upright posts according to claim 10 as an exterior building wall, slotted in courses substantially horizontally along its exterior face and accommodating decorative facing means whenever therein along that face.

12. Method of constructing a building wall according to claim 10, comprising the steps of placing a plurality of flanged posts upright and on centers spaced apart at successive intervals along the building perimeter, providing a plurality of preformed lightweight rectangular wall panels as long widthwise as the center-to-center spacing interval, the panels having substantially horizontal top and bottom edges extending between vertical side edges and having reinforcing members extending from one vertical side edge to the opposite vertical side edge, with slots along and within their opposite vertical side edges to receive the post flanges substantially entirely therewithin, inserting such panels between adjacent pairs of posts with the flanges received within the slots and thus substantially concealed from the exterior.

13. Building wall construction method according to claim 12, wherein the posts are H-shaped in plan, thus having a pair of spaced parallel flanges aligned and extending in opposite directions, and wherein the wall panels are doubly slotted along their vertical side edges and thereby adapted along each vertical side edge to receive an adjacent pair of post flanges substantially entirely therewithin from the top edge to the bottom edge of an adjacent panel, wherein the reinforcing members are substantially channel-shaped, oriented inverted along the top edge and upright along the bottom edge of the panel, and extending therealong from one vertical side edge to the opposite vertical side edge of the panel, and including the step of overlapping the top of the post flanges with the inverted channel.

14. Building wall construction method according to claim 13, including the step of securing the reinforcing members at their respective ends to adjacent flanges by means of suitable fasteners.

15. Building wall construction method according to claim 14, wherein the posts have bases extending to a base below the level of the bottom edge of the panel, and including the step of placing the bases of the posts in a footing constructed along the building perimeter.

16. Building wall constructed according to the method of claim 15.

17. Method of constructing a post-and-panel building wall with a plurality of flanged supporting posts spaced at given center-to-center distance intervals along the wall, and a plurality of two-faced panels of given thickness between faces, substantially rectangular shape, with substantially horizontal top and bottom edges, and with vertical side edges spaced apart by the wall width corresponding to the center-to-center interval, comprising steps of placing the posts upright at given center-to-center intervals, aligning their flanges mutually in the wall direction, and embedding their bases in below-grade footings; and reinforcing each panel horizontally, doubly slotting each panel along its vertical side edges to receive the flanges of adjacent posts therein, installing each wall panel between two adjacent posts with the post flanges within the slotted vertical edges of the panel, with the panel thereby held upright, and with the panel weight supported directly by the posts in at least substantial part.

18. Method according to claim 17, wherein the panels include a top horizontal panel-reinforcing member extending substantially horizontally from side-to-side of the panel, and including the step of fastening ends of that member to the post flanges.

19. Method according to claim 17, wherein the panels include a bottom horizontal panel-reinforcing member extending substantially horizontally from side-to-side of the panel, and including the step of fastening ends of that member to the post flanges.

* * * * *